United States Patent [19]

Bergqvist et al.

[11] Patent Number: 4,987,955

[45] Date of Patent: Jan. 29, 1991

[54] PERMANENTLY JOINED PLATE HEAT EXCHANGER

[75] Inventors: Jan-Ove Bergqvist, Malmö; Jarl Andersson, Lund, both of Sweden

[73] Assignee: Alfa-Laval Thermal AB, Tumba, Sweden

[21] Appl. No.: 295,216

[22] PCT Filed: May 25, 1988

[86] PCT No.: PCT/SE88/00276

§ 371 Date: Dec. 28, 1988

§ 102(e) Date: Dec. 28, 1988

[87] PCT Pub. No.: WO88/09473

PCT Pub. Date: Dec. 1, 1988

[30] Foreign Application Priority Data

May 29, 1987 [SE] Sweden ..... 8702258

[51] Int. Cl.[5] ..... F28F 3/08

[52] U.S. Cl. ..... 165/167; 165/166

[58] Field of Search ..... 165/166, 167

[56] References Cited

U.S. PATENT DOCUMENTS

| | | | |
|---|---|---|---|
| 3,240,268 | 3/1966 | Armes | 165/167 |
| 4,470,455 | 9/1984 | Sacca | 165/167 |
| 4,781,248 | 11/1988 | Pfeiffer | 165/167 |

FOREIGN PATENT DOCUMENTS

| | | | |
|---|---|---|---|
| 2601231 | 7/1976 | Fed. Rep. of Germany | 165/167 |
| 2107845A | 5/1983 | United Kingdom | 165/167 |
| 2128726A | 5/1984 | United Kingdom | 165/166 |

*Primary Examiner*—Martin P. Schwadron
*Assistant Examiner*—Allen J. Flanigan
*Attorney, Agent, or Firm*—Davis Hoxie Faithfull & Hapgood

[57] ABSTRACT

The present invention refers to a plate heat exchanger comprising a package of heat exchange plates (2), each having a peripheral portion (17) and with this a heat exchanger portion (9) and several port portions with through-flow ports forming inlet and outlet channels through the package. Said heat exchange plates (2) are permanently joined to each other along their peripheral portions (17) and at a variety of places in their heat exchange portions (9) in such manner that they leave flow passages between adjacent heat exchange plates (2), and between an outer line (13) and an inner line (14) located closer to the inlet and outlet channel, respectively. According to the invention means (19) is arranged to keep the port portions of the heat exchange plates together along the inlet and outlet channels, said means (19) being placed between said outer line (13) and the inlet or outlet channel along each of the inlet and outlet channels in the plate interspace communicating with said inlet and outlet channel, respectively.

7 Claims, 2 Drawing Sheets

PERMANENTLY JOINED PLATE HEAT EXCHANGER

Figure 1:
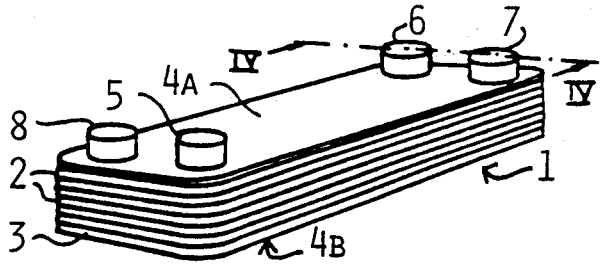

The present invention refers to a plate heat exchanger comprising a package of heat exchange plates, each having a peripheral portion and inside of this a heat exchange portion and several port portions with throughflow ports, the heat exchange plates being permanently joined to adjacent heat exchange plates of the package both along their peripheral portions and at many places in their heat exchange portions in such manner that they leave flow passages between adjacent heat exchange plates, the ports of the plates being aligned and forming first inlet and outlet channels through the package for a first heat exchange medium, which communicate with every other flow passage between the heat exchange plates, and second inlet and outlet channels through the package for a second heat exchange medium, which communicate with remaining flow passages between the heat exchange plates, and along each of the inlet and outlet channels the port portions of adjacent heat exchange plates, which form a flow passage separated from the inlet and outlet channel, respectively, being permanently joined around the inlet and outlet channel between an outer line and an inner line located closer to the inlet and outlet channel respectively.

Plate heat exchangers of this kind are previously known, for example from US 3 240 268 and GB A 2 005 398. Because the heat exchange plates are permanently joined to each other neither separate gaskets not between the plates and or an outer frame to hold the plates together are required. Therefore, it is possible to produce plate heat exchangers of this kind relatively cheaply. The expression permanently joined quotation marks refers mainly to soldering but also for example welding or glueing.

An essential disadvantage with known permanently joined plate heat exchangers is that they are limited to certain pressures, which are considerably lower than those permitted in a plate heat exchanger provided with an outer frame to keep the heat exchange plates together. At a pressure which overloads a permanently joined plate heat exchanger a leakage will arise, and it has now shown that such leakage as a rule is located at the port portions and/or the peripheral portions of the heat exchange plates in connection with the inlet and outlet channels. The reason for this is probably that the plate heat exchanger in the port portions of the plates has relatively large projected areas without connecting joints between the heat exchange plates. The joints located closest to these portions .known plate heat therefore risk overloading and tearing up. In exchangers these joints are located at a considerable distance from the edge of the inlet or the outlet channels and usually first at the peripheral portions of the plates, which as mentioned are joined to a peripheral sealing between the heat exchange plates. Said considerable distance of the known plate heat exchangers has been considered necessary to give sufficient space for a sealing ring, which must be placed in the area between the said outer and the said inner line at an end plate of the plate heat exchanger. Furthermore a margin is required in the area for said sealing ring since during pressing of the heat exchange portions of the heat exchange plates the usually round ports often are deformed so that they become slightly oval.

The object of the present invention is to eliminate the above mentioned disadvantages of the previously known permanently joined plate heat exchangers and to provide a plate heat exchanger of the initially described kind which allows a considerably higher pressure load than previously known plate heat exchangers of this kind.

This object is achieved by a plate heat exchanger of the initially described kind, which mainly is characterized in means arranged to keep the port portions of the heat exchange plates together along the inlet and outlet channels, said means being placed along each of the inlet and outlet channels in the plate interspaces communicating with said inlet and outlet channels, respectively, and in each such plate interspace being permanently connected to both of the heat exchange plates delimiting the plate interspace in question in an area around the inlet and outlet channels, respectively, located between said outer line and the inlet or outlet channel itself.

Preferably the connecting means are arranged in an area round the inlet and outlet channels respectively, located between said inner line and the inlet or outlet channels themselves.

In a preferred embodiment of the invention each connecting means at least partly constitutes an integral part of a heat exchange plate. Preferably the heat exchange plates are made of a thin material and by means of pressing are provided with projections on both sides, each connecting means comprising a projection pressed out from the port portion of a heat exchange plate. The port portions of two adjacent plates, which port portions surround an inlet or outlet channel, communicating with the flow passage formed by the plates, are preferably placed in the two end planes of the plates, located furthest from each other, and each of the connecting means is formed of projections from two adjacent plates, which projections are permanently joined to each other.

Preferably the connecting means placed in the different spaces between the plates, are arranged in line with each other perpendicularly to the heat exchange plates along inlet and outlet channels, respectively.

Each inlet and outlet channel is open at its one end and closed at its other end, and an end plate placed at the said other end, has a non-penetrated port portion comprising connecting means, which corresponds to said connecting means of the heat exchange plates, in areas around inlet and outlet channels, and stiffening projections pressed out inside of said connecting means.

By providing each heat exchange plate according to the invention with connecting means also within the above said inner line in each port portion, which means is formed by pressing together with the pressing of the remaining portions of the plate, distortion of the ports of the plate to an oval shape can be avoided. In this way the above mentioned margin of the area for a sealing ring at the end plate of the heat exchanger can be utilized for the forming of the just mentioned connecting means within said inner line in each port portion. Thus, it has been shown possible by the invention to improve the resistance of the heat exchanger without requiring the heat exchange areas of the plates or the ports of the plates to be made smaller.

Figure 2:
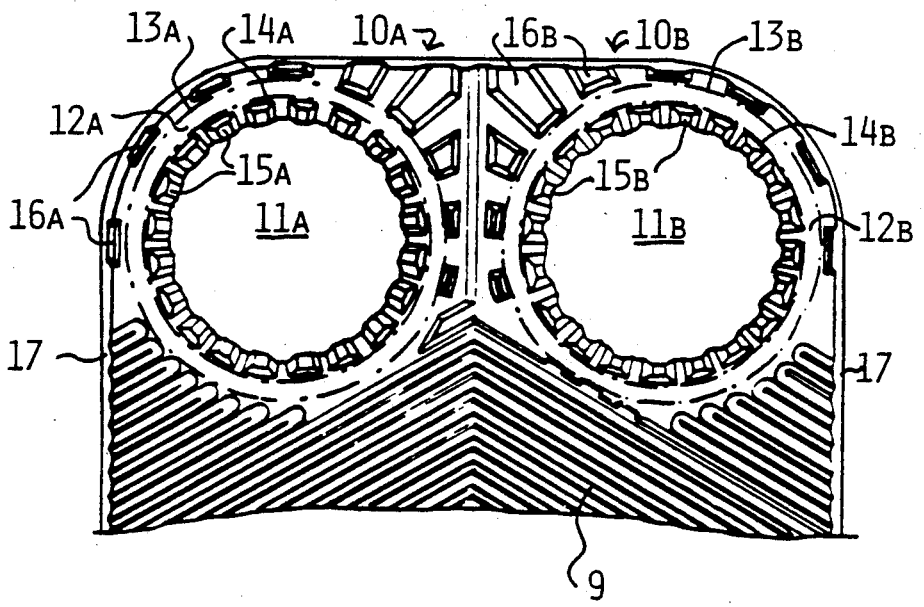
Figure 3:
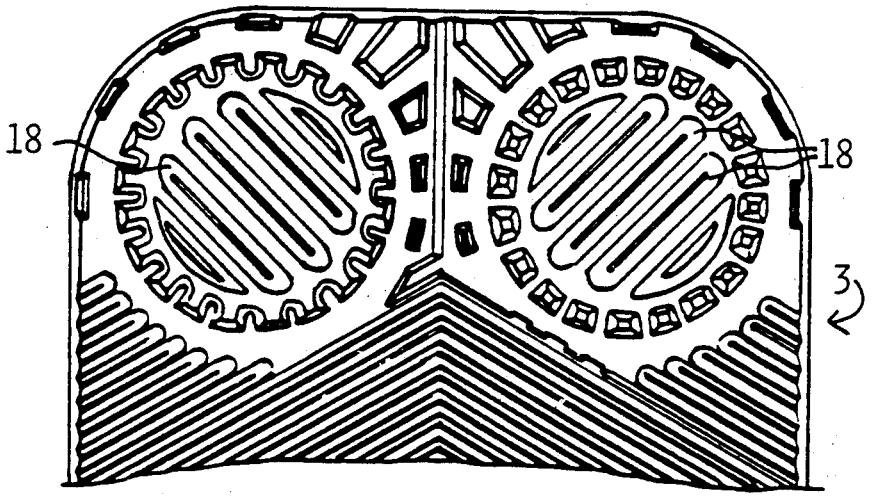
Figure 4:
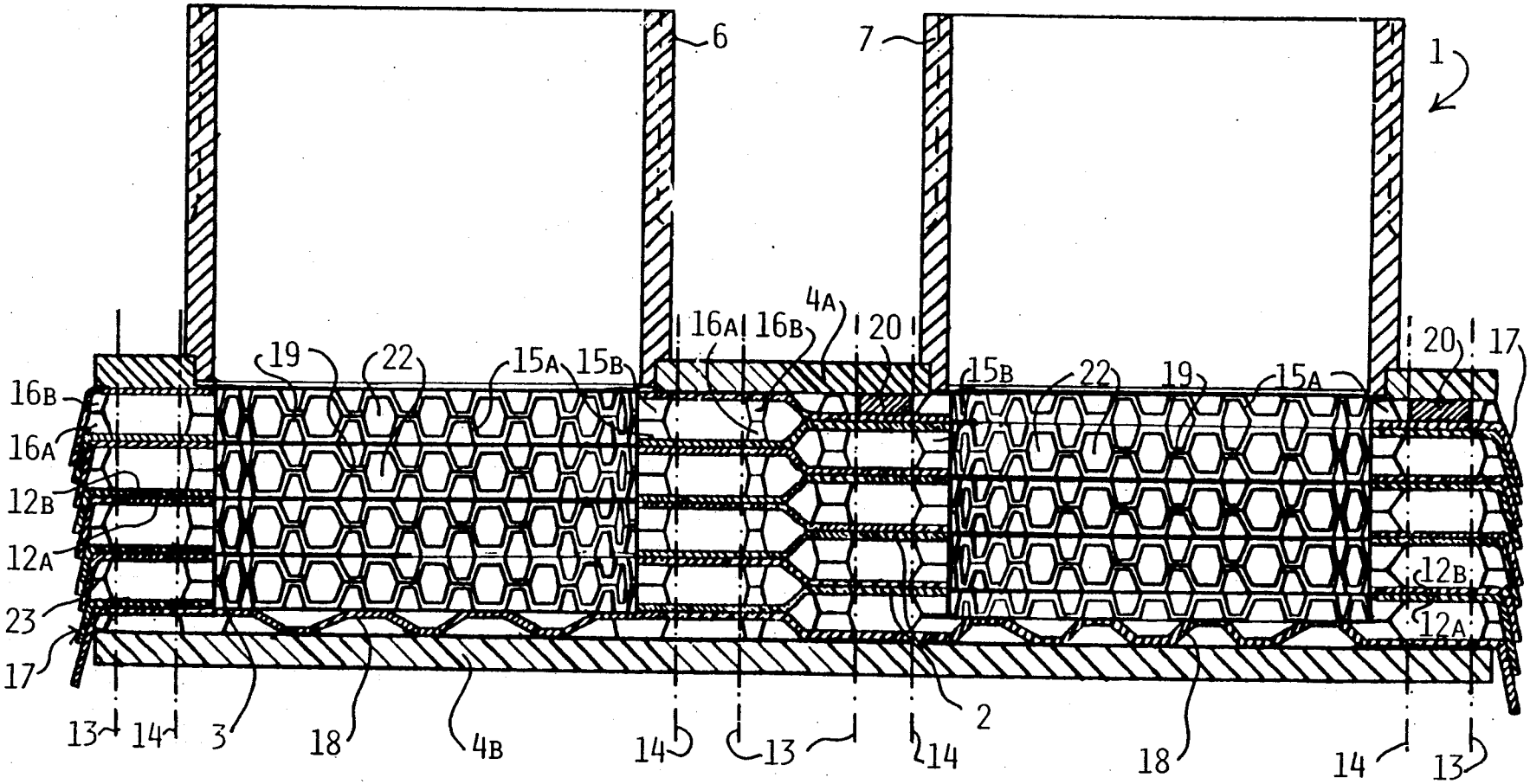

In the following the invention will be described more in detail with reference to the accompanying drawings, in which FIG. 1 shows a perspective view of a plate heat exchanger of the kind according to the invention, FIG. 2 shows a part of a heat exchange plate intended for a plate heat exchanger according to the invention, FIG. 3 shows a part of an end plate intended for a plate heat exchanger according to the invention, and FIG. 4 shows a cross-section view through a plate heat exchanger along the line IV—IV in FIG. 1.

In FIG. 1 there is shown a plate heat exchanger 1, comprising a package of heat exchange plates 2, an end plate 3 and outer cover plates 4*a* and 4*b* on the upper side and the lower side respectively of the package. The plate heat exchanger 1 also has a first and second inlet 5 and 6 respectively and a first and second outlet 7 and 8 respectively for two heat exchange media.

In FIG. 2 there is shown an end portion of an elongated heat exchange plate 2, provided with a press pattern on both of its sides, which extends between two end planes of the heat exchange plate 2. One obliquely projecting peripheral portion 17 of the plate 2 extends around the periphery of the heat exchange plate, and within this there is a port portion 1O*a*, located in one of the end planes of the plate, and a port portion 1O*b*, located in the other end plane of the plate. The port portions 1O*a* and 1O*b* have throughflow ports 11*a* and 11*b*, respectively. Corresponding port portions located in said two end planes are provided at another end portion (not shown) of the heat exchange plate 2. Further there is a heat exchange portion 9, located between the port portions situated at each end of the heat exchange plate 2 having a corrugation pattern consisting of ridges and valleys, extending between said two end planes. Around the port 11*a*, situated in a lower end plane, there is an essentially flat connecting area 12*a*, limited by an outer line 13*a* and an inner line 14*a*. Inside of the inner line 14*a* there are a number of projections 15*a* and outside of the outer line 13*a* there are a number of projections 16*a*. The projections 15*a* and 16*a* extend from the lower end plane to the said upper end plane. In a similar way, around the port 11*b*, located in the upper end plane, there is a connecting area 12*b*, limited by an outer line 13*b* and an inner line 14*b*. Likewise there is a number of projections 15*b* and 16*b*, which, however, extend from the upper end plane to the lower end plane.

The shown heat exchange plate 2 is intended to be joined with a similar heat exchange plate which has been rotated 180° in the plane of the plate. A heat exchange plate located behind the heat exchange plate 2 will abut against the rear side of the connecting area 12*a* and against the rear side of the projections 15*b* and 16*b*, and a heat exchange plate located in front of the heat exchange plate 2 will with its rear side abut against the connecting area 12*b* and against the projections 15*a* and 16*a*. Further the respective heat exchange plate located on each side of the heat exchange plate 2 will abut against respective side of the peripheral portion 17 and at a variety of points over the respective side of the heat exchange portion 9, since the ridges and valleys of the corrugation pattern for two adjacent heat exchange plates will cross each other.

In FIG. 3 there is shown an end portion of an end plate 3, comprising two non-penetrated port portions with stiffening projections 18 but which otherwise corresponds to the heat exchange plate 2 shown in FIG. 2. The stiffening projections 18 extend from the upper end plane to the lower end plane.

In FIG. 4 there is shown a cross-section through the plate heat exchanger 1 shown in FIG. 1, extending through the part of the heat exchanger comprising the second inlet pipe 6 and the first outlet pipe 7. This cross-section also corresponds to a corresponding cross-section through the first inlet pipe and the second outlet pipe of the heat exchanger.

The plate heat exchanger 1 comprises eight heat exchange plates 2, of the kind shown in FIG. 2., and a lower end plate 3 of the kind shown in FIG. 3, which are arranged above each other between the upper, outer cover plate 4*a* and the lower, outer cover plate 4*b*. The ports of the heat exchange plates are aligned, so that they form an inlet channel and an outlet channel, which at the bottom are limited by the non-penetrated port portions of the end plate and which at the top communicate with the inlet pipe 6 and the outlet pipe 7, respectively.

Two adjacent heat exchange plates 2 delimit a flow passage between the plates, depending on the ridges of the corrugation pattern in the heat exchange portion of the plates crossing each other. Because the connecting area 12*b* of one of the plates abuts against the connecting area 12*a* of the other plate said flow passage only communicates with either the inlet channel or the outlet channel at respective end portion of the plates. Also the projections 15*a* and the projections 16*a* respectively., of one of the plates abut against the projections 15*b* and the projections 16*b* respectively., of the other plate.

The projections 15*a* and 15*b* abutting each other form connecting means 19, keeping together the port portions of the two heat exchange plates along the inlet and the outlet channels, respectively. The connecting means 19 along each of the inlet and outlet channels are located in the plate interspaces which communicate with the inlet and the outlet channel respectively in an area located between the connecting areas 12*a* and 12*b* of the plates and the channel itself. Between the connecting means 19 in respective plate interspace there are openings 22 which communicate with the flow passage between the heat exchange plates. The lines 13 and 14 shown in FIG. 4., which delimit the connecting areas 12*a* and 12*b* of the plates, extend through the corresponding lines 13*a* and 13*b* and the lines 14*a* and 14*b*, respectively, as shown in FIG. 3.

In a similar way the projections 16*a* and 16*b*, abutting against each other, form connecting means 23, keeping together the port portions of the two adjacent heat exchange plates along the inlet and the outlet channel respectively. The connecting means 23 along each of the inlet and outlet channels is located in the plate interspaces, which communicate with the Inlet and the outlet channel, respectively, in an area which partly surrounds the inlet and the outlet channel, respectively, and which is located between the connecting areas 12*a* and 12*b* of the plates and adjacent parts of the peripheral portions 17 of the plates.

In the space between the upper cover plate 4*a* and the adjacent heat exchange plate 2, which appears either around the inlet channel or the outlet channel, there is a spacing ring 20 located in the connecting areas 12*a* and 12*b* respectively of the heat exchange plates 2. The spacing ring 20 also acts as a sealing between the heat exchange plate 2 and the cover plate 4*a*.

The end plate 3 located close to the lower cover plate 4*b* covers the inlet and outlet channels with its non-penetrated port portions and depending on the stiffening projections 18, abutting against the cover plate 4*b*, and the projections which correspond to the projections 15*a* and 15*b* of the heat exchange plates, a distance ring is not required between the cover plate 4b and the end plate 3.

The plate heat exchanger 1 according to the present invention comprises preferably heat exchange plates 2 with a rectangular form, but other forms could be possible, as round heat exchange Plates. The heat exchanger 1 is shown with one inlet channel and one outlet channel for each of the two heat exchange media, which inlet and outlet channels are located in the end portions of the heat exchange plates 2. A heat exchanger can of course be provided with several inlet or outlet channels. The shape of the channels and the location can be chosen freely.

The number of heat exchange plates 2 of the heat exchanger 1 is depends on desired capacity. For assembling the heat exchanger a suitable number of plates are piled on each other with solder in the shape of sheets placed between adjacent plates, whereupon the whole package is heated in an oven until said solder melts.

According to the present invention the connecting means 19 can, as an alternative, be formed of loose elements arranged between the heat exchange plates, but preferably the means 19 is formed as integral parts of respective heat exchange plates. The means 19 is formed of the projections 15*a* and 15*b*, which are pressed out from the port portions 1O*a* and 1O*b*, respectively, of the heat exchange plates and which thereafter are permanently joined with corresponding projections of adjacent heat exchange plates.

To obtain a preferred distribution of the forces between the connecting means 19, being located in the different plate interspaces, they are preferably aligned perpendicularly against the heat exchange plates 2 along respective inlet and outlet channels. The means 19 can be equally distributed around the inlet and outlet channels but they can also be arranged more sparsely in direction against the heat exchange portion 9 and more densely in remaining directions.

The means 19 and 23 proposed according to the invention, also forms a guide for the spacing ring 20, as shown in FIG. 4. This together with the circumstances that deformation of the port portions 1O*a* and 1O*b*, respectively, can be prevented during manufacture of the heat exchange plate 2, depending on the pressing out of the projections 15*a* and 15*b*, has the result that the margin required for the areas 12*a* and 12*b* around the ports can be considerably reduced compared with the margin required in known heat exchangers. It is thus possible to provide the heat exchanger with connecting means 19 within the connecting areas 12*a* and 12*b* of the heat exchange plates without changing the size of the ports.

The inlet and outlet channels are open at one end of the heat exchange package and closed at the other end of the heat exchange package. It is suitable that the end plate 3 located at said other end has a port portion without any through-port. This non-penetrated port portion is provided with the space-giving and stiffening projections 18.

What is claimed:

1. Plate heat exchanger comprising a package of heat exchange plates, each having a peripheral portion and within this a heat exchange portion and several port portions with throughflow ports, the heat exchange plates being permanently joined to adjacent heat exchange plates of the package both along their peripheral portions and at a variety of places in their heat exchange portions in such manner that they leave flow passages between adjacent heat exchange plates, the ports of the plates being aligned and forming first inlet and outlet channels through the package for a first heat exchange medium, which communicate with every other flow passage between the heat exchange plates, and second inlet and outlet channels through the package for a second heat exchange medium, which communicate with remaining flow passages between the heat exchange plates, and along each of the inlet and outlet channels the port portions of adjacent heat exchange plates which form a flow passage separated from the inlet and outlet channel, respectively., being permanently joined around the inlet and outlet channel, respectively, between an outer line and an inner line, located closer to the inlet and outlet channel, respectively, characterized by means arranged to keep the port portions of the heat exchange plates together along the inlet and outlet channels, said means being placed along each of the inlet and outlet channels in the plate interspaces communicating with said inlet and outlet channels, respectively, and in each such plate interspace being permanently connected to both of the heat exchange plates delimiting the plate interspace in question in an area around the inlet and outlet channel, respectively., located between said inner line and the inlet or outlet channel, itself.

2. Plate heat exchanger according to claim 1, characterized in that each connecting means at least partly constitutes an integral part of a heat exchange plate.

3. Plate heat exchanger according to claim 2, characterized in that the heat exchange plates are made of thin material and by means of pressing are provided with projections on both of their sides., each connecting means comprises a projection being pressed out from the port portion of a heat exchange plate.

4. Plate heat exchanger according to claim 3, characterized in that the port portions of two adjacent plates, which port portions surround an inlet or outlet channel communicating with the flow passage formed by the plates, are placed in the end plates of the plates, located furthest from each other, and that each of the connecting means is formed of projections from two adjacent plates, which projections are permanently joined to each other.

5. Plate heat exchanger according to claim 4, characterized in that connecting means placed in the different sPaces between the plates, is arranged in line with each other PerPendicularly to the heat exchange plates along respective inlet and outlet channel.

6. Plate heat exchanger according to claim 1, characterized in that each inlet and outlet channel is open at its one end and closed at its other end, and that an end plate placed at the said other end, has a non-penetrated port portion comprising connecting means, corresponding to said connecting means of the heat exchange plates, in areas around the inlet and outlet channels and stiffening portions pressed out within said connecting means.

7. Plate heat exchanger according to claim 6, to which an outer cover plate is placed close to the end plate, characterized in that said stiffening projections abut against the outer cover plate.

* * * * *

UNITED STATES PATENT AND TRADEMARK OFFICE

CERTIFICATE OF CORRECTION

PATENT NO. : 4,987,955

DATED : January 29, 1991

INVENTOR(S) : Jan-Ove Bergvist and Jarl Anderson

It is certified that error appears in the above-identified patent and that said Letters Patent is hereby corrected as shown below:

Abstract, line 4, change "exchanger" to --exchange--.

Column 1, line 54, delete "known plate heat".

Column 1, line 55, after "In" insert --known plate--.

Column 4, line 50, change "Inlet" to --inlet--.

Column 5, line 6, change "Plates" to --plates--.

Column 5, line 15, delete "is".

Column 6, line 50, change "sPaces" to --spaces--.

Column 6, line 51, change "PerPendicularly" to --perpendicularly--.

Signed and Sealed this

Twenty-seventh Day of October, 1992

*Attest:*

DOUGLAS B. COMER

*Attesting Officer*

*Acting Commissioner of Patents and Trademarks*